United States Patent [19]

Vaughn et al.

[11] Patent Number: 5,037,241

[45] Date of Patent: Aug. 6, 1991

[54] METHOD AND APPARATUS FOR SETTING A SUPERSTRUCTURE ONTO AN OFFSHORE PLATFORM

[75] Inventors: Stephen D. Vaughn; George F. Davenport; Ray L. Steinmetz, all of Houston, Tex.

[73] Assignee: Exxon Production Research Company, Houston, Tex.

[21] Appl. No.: 501,597

[22] Filed: Mar. 29, 1990

[51] Int. Cl.[5] ..... E02D 25/00

[52] U.S. Cl. ..... 405/209; 405/203

[58] Field of Search ..... 405/209, 203, 195; 114/29, 31

[56] References Cited

U.S. PATENT DOCUMENTS

| | | | |
|---|---|---|---|
| 2,934,905 | 5/1960 | Woolslayer et al. | 405/209 |
| 2,959,015 | 11/1960 | Beck . | |
| 3,058,311 | 10/1962 | Woolslayer et al. | 405/209 |
| 4,556,004 | 12/1985 | Lamy et al. . | |
| 4,662,788 | 5/1987 | Kypke et al. . | |
| 4,668,127 | 5/1987 | Steele | 405/203 X |
| 4,714,382 | 12/1987 | Khachaturian . | |
| 4,829,924 | 5/1989 | Dysarz . | |
| 4,874,269 | 10/1989 | Dysarz | 405/209 |

FOREIGN PATENT DOCUMENTS

| | | | |
|---|---|---|---|
| 2008652 | 6/1979 | United Kingdom | 405/209 |

OTHER PUBLICATIONS

"Can a Jackup Rig Install a Fixed Platform?", Drilling Contractor, Oct./Nov. 1989, pp. 13–15.

*Primary Examiner*—Dennis L. Taylor
*Assistant Examiner*—J. Russell McBee
*Attorney, Agent, or Firm*—Pravel, Gambrell, Hewitt, Kimball & Krieger

[57] ABSTRACT

An improved apparatus is disclosed for setting a deck structure or other marine superstructure using a barge mounted cantilevered support structure. The cantilevered support structure is attached at one end of a floating vessel. The cantilevered support structure extends past the edge of the vessel and, in one embodiment, includes means for rotating parallel support members about the deck of the floating vessel permitting the cantilevered support structure to be raised and lowered while it remains substantially parallel with the top of the offshore platform enabling the superstructure to engage the top of a previously installed offshore platform in a synchronized manner. Alternatively, this superstructure may be aligned directly over the platform. A cantilevered drilling rig is then aligned over the cantilevered support structure and used to lift the deck structure or marine superstructure, permitting the vessel and cantilevered support structure to move. The drilling rig is then used to lower the marine superstructure onto the top of the previously installed offshore platform.

5 Claims, 4 Drawing Sheets

FIG. 1
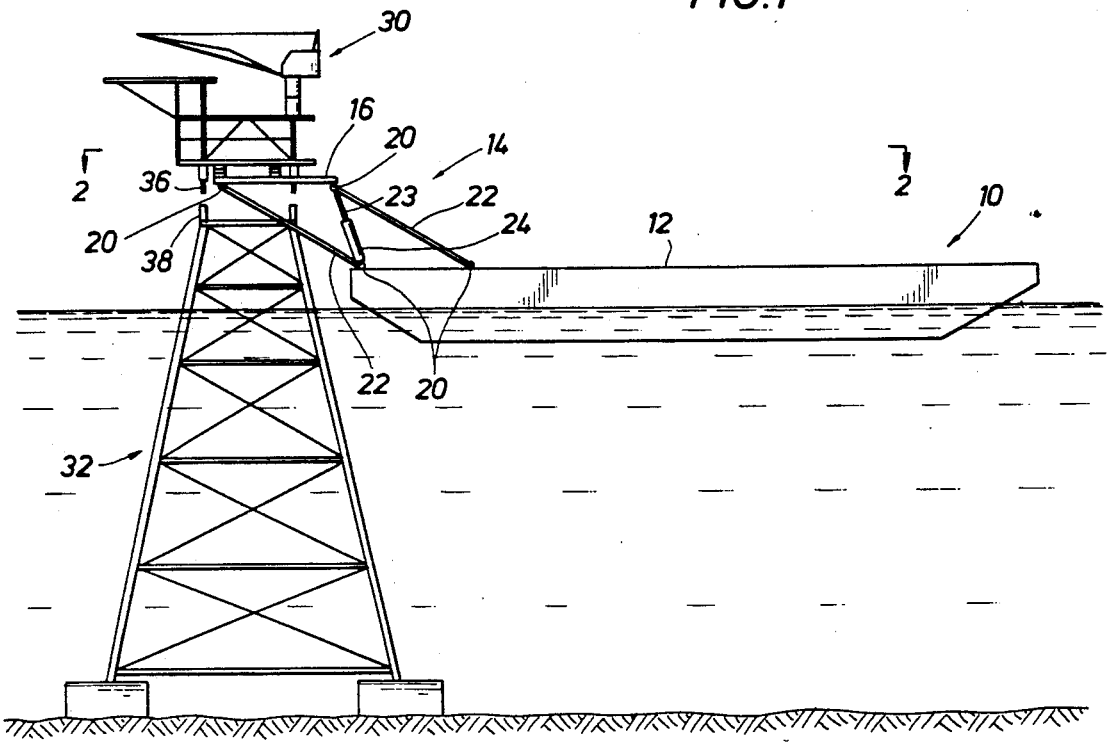
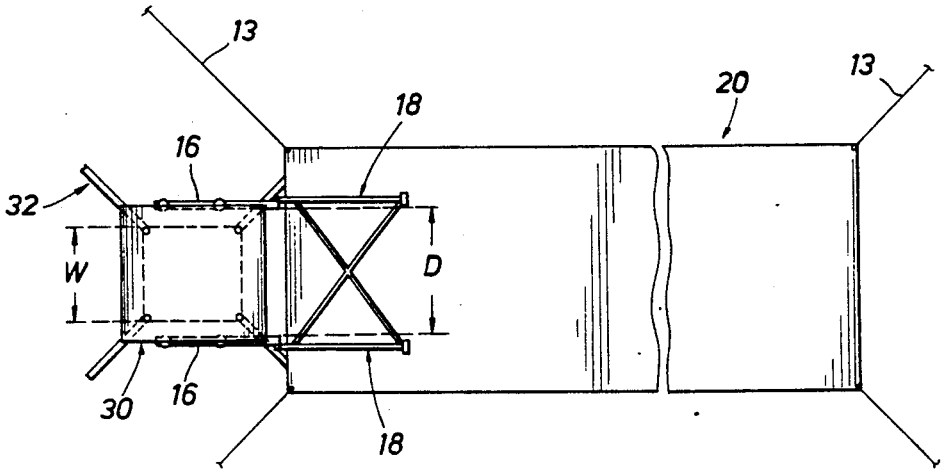
FIG. 2

METHOD AND APPARATUS FOR SETTING A SUPERSTRUCTURE ONTO AN OFFSHORE PLATFORM

BACKGROUND OF THE INVENTION

1. Field of the Invention

This invention relates to an improved method and apparatus for installing a superstructure onto an offshore platform. More particularly, the invention relates to an improved method and apparatus for installing a deck structure onto an offshore platform in exposed water offshore using a barge mounted, cantilevered support structure.

2. Description of the Prior Art

Historically, the placement of a deck structure or a superstructure onto an offshore platform has been performed either by setting the deck or superstructure onto the platform using the crane of a derrick barge or lowering the deck onto the platform using a float-on, deck-setting procedure. This second method typically involves the maneuvering of the deck structure into an existing slot in the platform at the water line and then ballasting the barge which is temporarily supporting the deck until the deck structure engages the offshore platform. At that point, the deck loads have been transferred to the platform and the ballasted barge may be removed from the platform slot. A general discussion of the float-on procedure is shown in FIGS. 1 and 2 of U.S. Pat. No. 4,662,788 and the accompanying detailed description.

Both of these methods, however, have distinct disadvantages. The use of a crane on a derrick barge has lifting limitations primarily controlled by the lifting capacity of the crane, which is largely a function of the angle of the main boom, and the size of the derrick barge. Frequently, in designing the deck structure, the engineer must take into account the capacity of available derrick barges. The alternate float-on, deck-setting procedure also has significant limitations in that the offshore platform either must have a large enough water plane to provide enough of a slot between the principal support legs of the platform to accommodate a barge large enough to support the deck structure during the installation phase or the operation must be performed in a sheltered environment using multiple barges moored around the platform to create enough capacity to support a deck and permit a deck setting operation.

Therefore, the need exists for an improved method and apparatus for setting a deck structure or a superstructure which does not increase the expense associated with a large derrick barge but has the flexibility of accommodating smaller offshore platforms which do not have a large enough in-place water plane to support the float-on method.

U.S. Pat. No. 4,829,924 to Dysarz discloses a semisubmersible vessel 10 to set a deck structure 17 onto a fixed offshore platform 15. However, the procedure disclosed by Dysarz is complex and requires an elaborate semisubmersible to control the vertical displacement of a deck structure which is supported off one end of the barge. Furthermore, the disclosure by Dysarz still has substantial limitations associated with the float-on method in that the trusses 11 which support the lifting beams 9 are on the interior of the jacket 15 and would interfere with the lowering of the deck superstructure on smaller platforms for the same reason that the float-on method is inadequate in view of the smaller interior water planes. Dysarz also requires a complex curved guide frame 7 to assist the semisubmersible vessel 10 and lifting beams 9 during the raising and lowering phases.

Accordingly, there is a need for an improved method and apparatus for installing a deck structure or a superstructure which is inexpensive and simple and avoids the complications of the Dysarz disclosure.

SUMMARY OF THE INVENTION

Briefly, the apparatus includes a floating vessel having a deck structure. A cantilevered support structure is attached to the deck structure at one end of the vessel. The cantilevered support structure extends over the end of the vessel and includes at least two sets of parallel support members and means for rotating the parallel support members about the deck structure of the vessel. This permits the elevational movement of the cantilever support structure in such a manner that the top of the cantilevered support structure remains substantially parallel to the top of the legs of the offshore platform. This, in turn, permits the synchronized engagement of the deck structure or superstructure with the offshore platform.

In an alternate embodiment of the present invention, the cantilevered support structure is attached in a rigid manner to the vessel and a deck structure is supported thereon. The cantilevered support structure is aligned over the previously installed offshore platform. A jack-up drilling vessel having a cantilevered drilling rig is then aligned over the deck structure; the rig is used to lift the deck structure. Once lifted, the vessel and cantilevered support structure attached thereto are removed. The rig then lowers the deck structure onto the top of the offshore platform for final joining.

In performing the improved method, a floating vessel having a cantilevered support structure with at least two sets of parallel support structures attached at one end of the deck structure of the floating vessel is provided. The deck structure is supported on the cantilevered support structure and aligned over the offshore platform. The cantilevered support structure is then pivoted or rotated such that the top platform or deck of the cantilevered support structure remains substantially parallel with the water surface and the top of the legs of the offshore platform. The lowering operation is continued until the deck structure is completely supported by the offshore platform. At that point, the floating vessel having the cantilevered support structure attached thereto is removed.

In performing an alternate version of the improved method, a floating vessel having a fixed cantilevered beam is provided. The deck structure is supported on the cantilever beam and aligned over the offshore platform. A jack-up drilling vessel is also provided having a cantilevered drilling rig. Once the deck structure is aligned over the offshore platform, the cantilevered drilling rig of the jack-up vessel is also aligned over the platform and is used to lift the deck structure from the cantilevered support structure. At that point, the vessel with cantilevered support structure attached thereto is removed and the rig is used to lower the superstructure onto the top of the previously installed offshore platform.

Various other features, characteristics and advantages of the present invention will be apparent after a reading of the following specification and all such variations, characteristics or other advantages of the present invention are intended to fall within the spirit and scope of the claims as appended hereto.

BRIEF DESCRIPTION OF THE DRAWINGS

FIG. 1 is an elevation view of the preferred embodiment of the present invention.

FIG. 2 is a plan view of the preferred embodiment of the present invention.

DETAILED DESCRIPTION OF THE INVENTION

Figure 3:
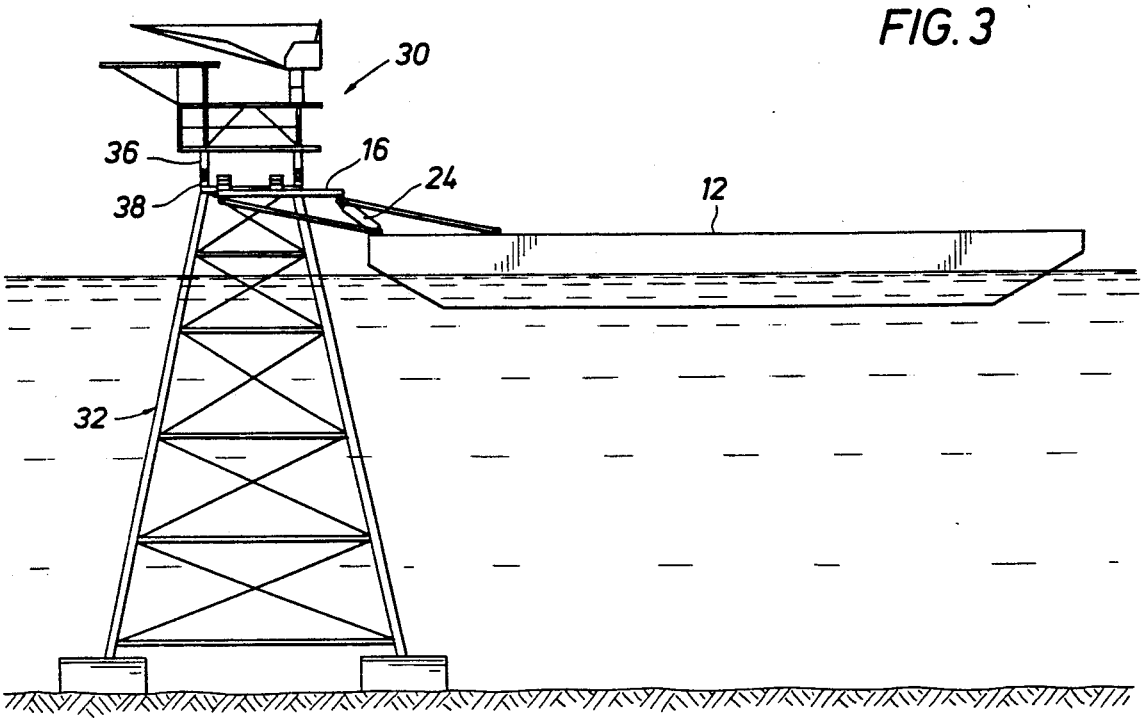
FIG. 3 is an elevation view of the preferred embodiment of the present invention illustrating a portion of the installation sequence.

Referring to FIGS. 1–4, with specific reference to FIGS. 1 and 2, a vessel 10 is shown having a deck 12. Attached at one end of the vessel 10 is a cantilevered support structure 14. The structure 14 includes a deck portion 16 attached to the vessel 10 by parallel support trusses 18. Each truss 18 includes at least two parallel support members 22 which are attached at one end to the deck portion 16 and their other end to the vessel 10 by means of hinge connections 20. Each truss 18 may be interconnected by stiffening cross members (not shown). The trusses 18 include a third support member 23 having a hydraulic jack 24 or similar device which permits a controlled variation in the length of the support member 23. In this manner, the deck portion 16 may be lowered or raised by adjusting the length of the support member 23 via the stroke of jack 24. This in turn permits the deck portion 16 to be lowered in such a manner that it remains substantially parallel with the deck 12 of the vessel 10, the water surface and the tops 38 of the legs of the offshore platform 32. The particular type of hydraulic jack 24 to use and its installation within support member 23 will be apparent to one skilled in the art in view of this disclosure.

Referring still to FIGS. 1 and 2, a deck structure 30 is shown supported by the cantilevered support structure 14. Initially, the superstructure 30 is held in a substantially horizontal position and aligned over an offshore platform 32 which has been previously installed. The vessel 10 may be held in position by a series of mooring lines 13 which are anchored to the ocean floor, and are well known to those skilled in the art. Such mooring spreads may include anchor work boats (not shown) with wenches capable of positioning the vessel 10 above the offshore platform 32.

With specific reference to FIG. 2, the trusses 18 are fabricated so that the distance "D" between the trusses is greater than the anticipated width "W" at the water line between the support legs of a typical offshore platform found in the region. In this manner, the trusses 18 will not interfere with any horizontal support members of the offshore platform 32 during the installation of the deck structure or marine superstructure 30.

Referring to FIGS. 1–4, following the positioning of the vessel 10 adjacent the offshore structure 32, the hydraulic jack 24 is retracted, reducing the length of the member 23 of each truss 18 thereby permitting the controlled lowering of the cantilevered support structure 14 as shown in FIG. 3. In this manner, the top of the cantilevered support structure is lowered with the deck portion 16 remaining parallel with the deck 12 of vessel 10 which is parallel with the water surface and the tops 38 of the legs of the offshore platform. Hydraulic jack 24 is retracted until such time as the support legs 36 of the deck structure 30 contact the tops of the legs 38 of the offshore platform. At that point, hydraulic jack 24 continues to be retracted until such time as the load from the deck structure 30 has been transferred entirely to the offshore platform.

Figure 4:
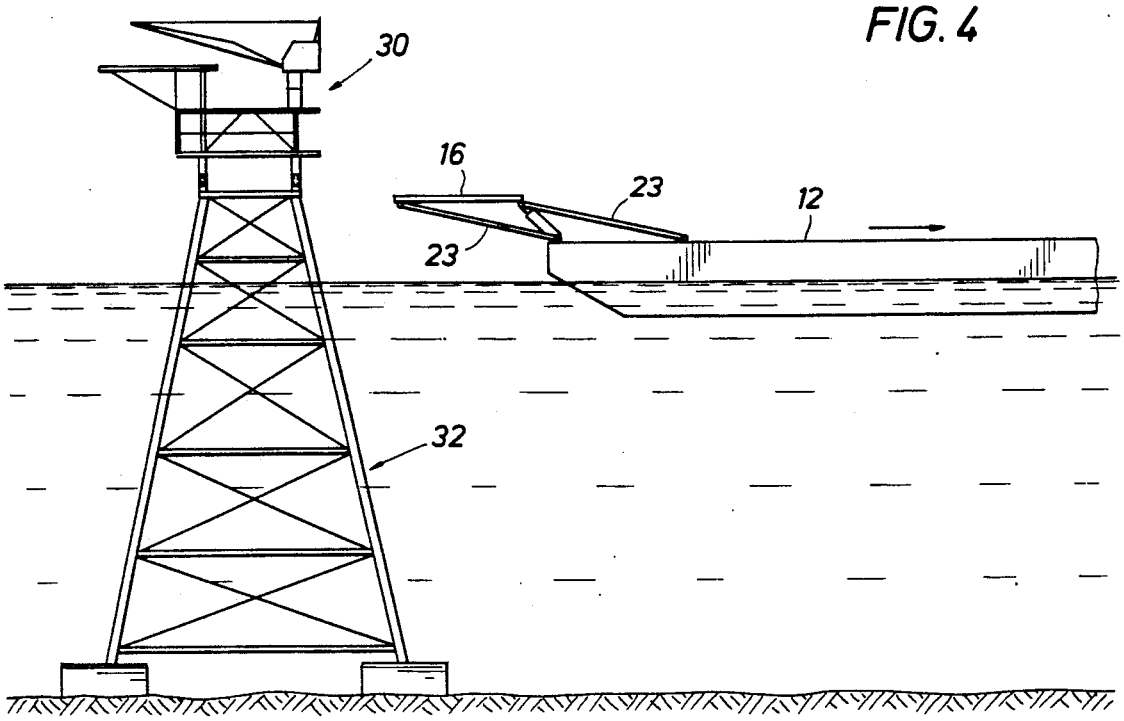
FIG. 4 is an elevation view of the preferred embodiment of the present invention illustrating the completion of the installation sequence.

Referring now to FIG. 4, the continued retraction of the hydraulic jack 24 is permitted until the deck portion 16 has completely cleared the bottom of the deck structure 30 and the vessel 10 may be removed without contacting or touching the deck structure 30.

Figure 5:
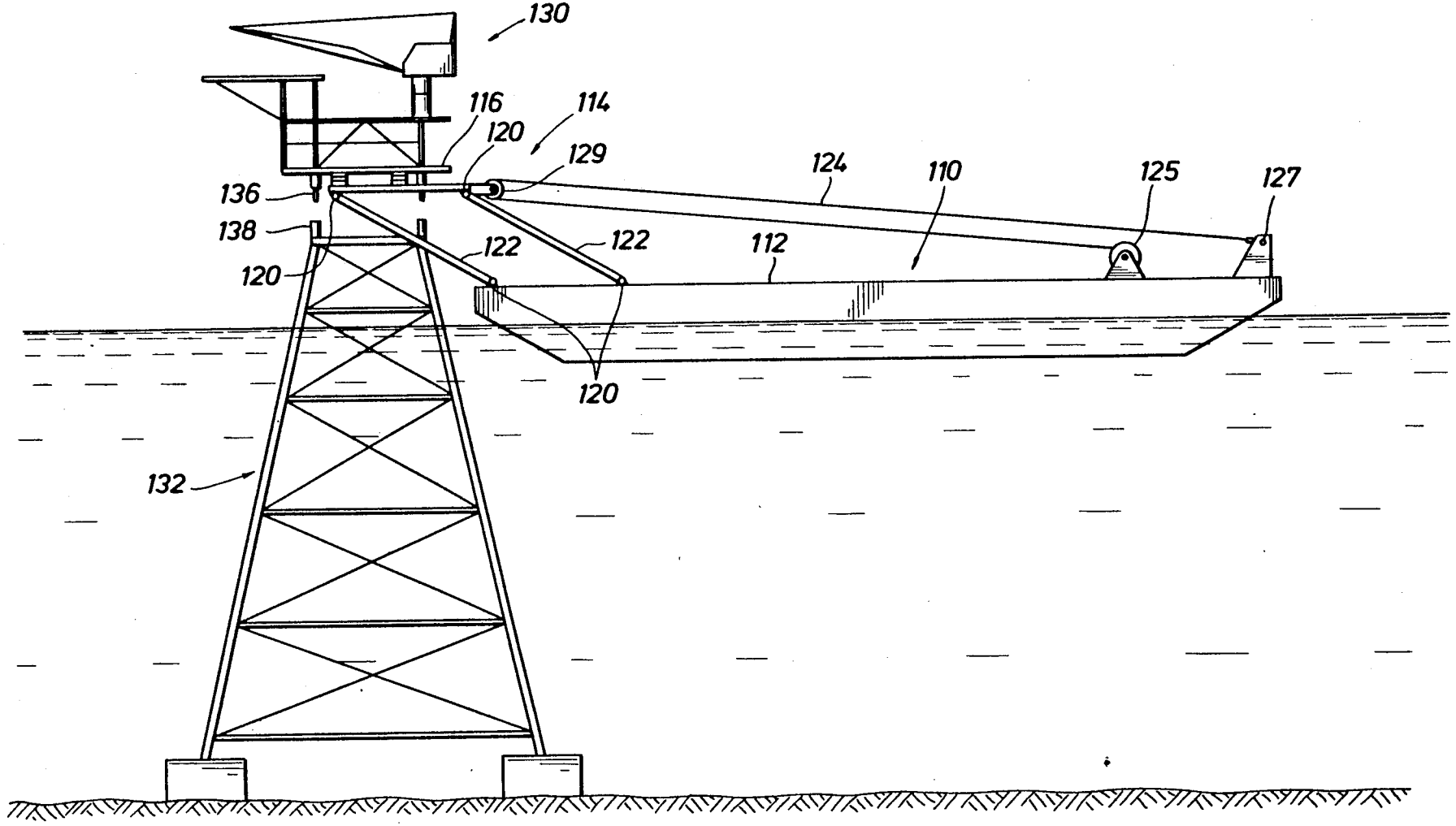
FIG. 5 is an elevation view of an alternate embodiment of the present invention.

Referring to the alternate embodiment shown in FIG. 5, a vessel 110 is shown having a deck 112. Also shown is a cantilevered support structure 114 which includes a deck portion 116 and primary support members 122. Deck portion 116 of the cantilever support structure 114 supports the superstructure 130. The embodiment in FIG. 5 operates in a similar manner to that shown in FIG. 1 except that the mechanism for rotating the primary support members 122 so that the elevation of deck 116 varies is a cable assembly 124/125. The cable 124 is tied down to the deck structure 127. It passes through a pulley 129 which is attached to the cantilevered support structure 114 and continues back to a wench 125, also mounted to the deck 12 of the vessel 10. Thus, rotation of the wench 125 causes the retraction or extension of the cable 124 so that the elevation of the deck structure 116 varies to accommodate the raising or lowering of the deck structure 130. Essentially, FIG. 5 illustrates a substitution of the cable/wench assembly 124/125 for the third support member 23/hydraulic jack 24 of FIG. 1.

Figure 6:
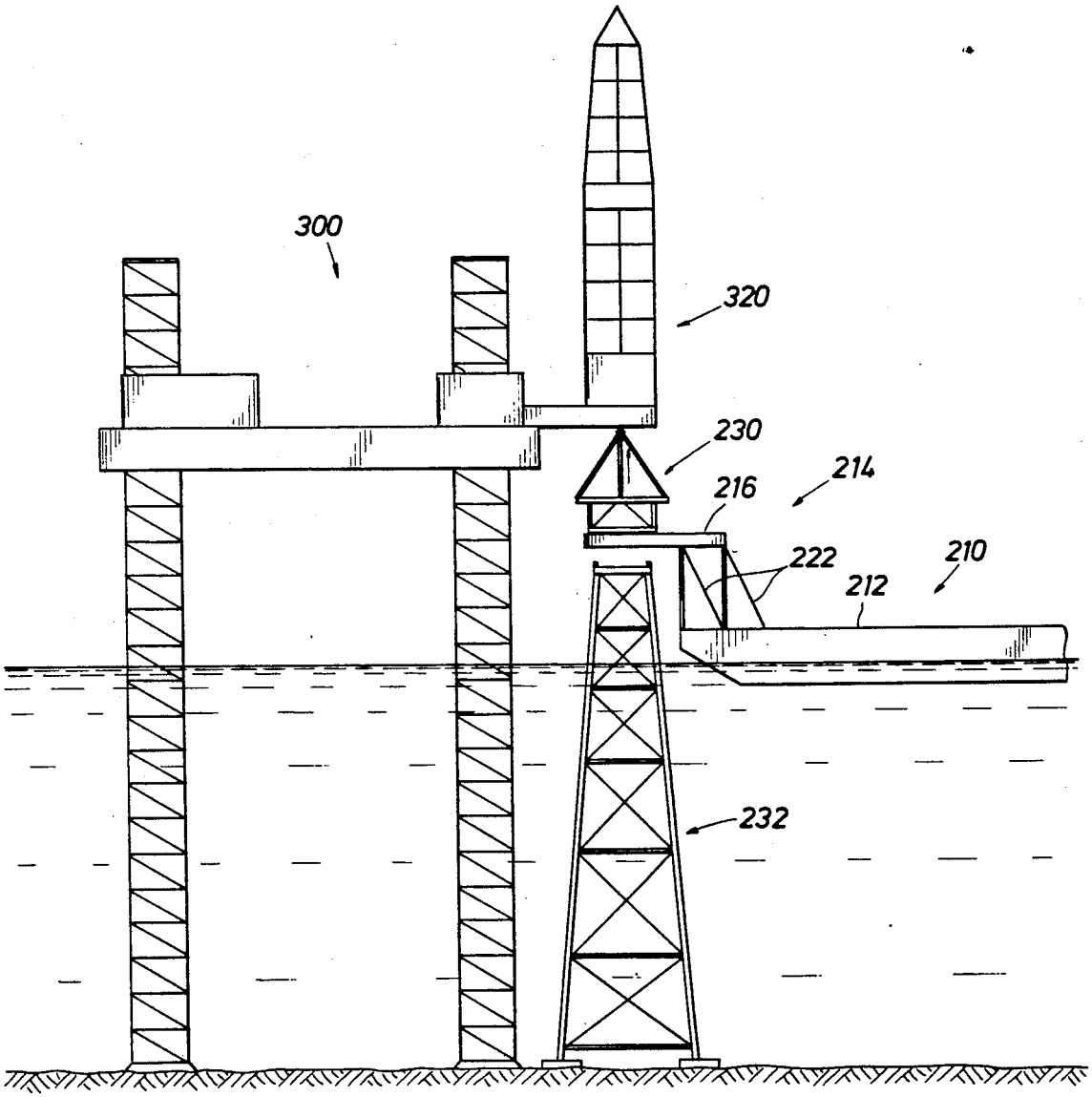
FIG. 6 is an elevation view of yet another alternate embodiment of the present invention.

Referring now to the alternate embodiment shown in FIG. 6, a vessel 210 is shown having a deck 212. Also shown is a cantilevered support structure 214 which includes a deck portion 216 and primary support members 222. Deck portion 216 of the cantilevered support structure 214 supports the superstructure 230.

Also shown in FIG. 6 is a jack-up drilling vessel 300 having a cantilevered drilling rig 320 which extends past the edge of the jack-up vessel 300. In this alternate embodiment, the cantilevered support structure 214 does not include a hydraulic jack 24 as discussed above with respect to the preferred embodiment. Rather, the cantilevered support structure 214 is fixed relative to the vessel 210, and cantilever drilling rig 320 serves to elevate the deck structure 230 from the cantilevered deck portion 216.

In the operation of the alternate embodiment, the vessel 210 is moored directly over the previously installed offshore platform 232. The drilling rig 320 is then positioned adjacent the fixed offshore platform 232 so that the cantilever drilling rig 320 is positioned directly over the superstructure 230. The hoisting capabilities of the drilling rig 320 are then used to raise the deck structure or superstructure 230 enough to permit the vessel 210 to be removed. The rig 320 is then used to lower the superstructure 230 onto the top of the offshore platform 232.

Inasmuch as the present invention is subject to many variations, modifications and changes in detail, it is intended that all subject matter discussed above or shown in the accompanying drawings be interpreted as illustrative and not in a limiting sense, in that any variations or modifications thereof be subject to the spirit and scope of the claims as appended hereto.

What is claimed is:

1. An apparatus for supporting and installing the superstructure of an offshore platform comprising:

a floating vessel having a deck structure;

a cantilevered support structure having a top platform and two principal support trusses, each support truss comprising two substantially parallel support members, said cantilevered support structure being attached at one end of said deck structure of said floating vessel and adapted to extend past the edge of said one end of said floating vessel to support said superstructure; and means for rotating each parallel support member about the deck structure of said vessel to modify the height of said cantilevered support structure, wherein said top platform of said cantilevered support structure remains substantially parallel with the top of said offshore platform during the change in height of said cantilevered support structure to permit the synchronized engagement of the superstructure with the offshore platform.

2. The apparatus according to claim 1, wherein said rotating means comprises:

a nonparallel support member attached at one end to one of the parallel support members and at its other end to the other end of said parallel support member; and a hydraulic jack mounted within said nonparallel support member.

3. The apparatus according to claim 1, wherein said rotating means comprises:

a cable extending from the deck structure of said vessel to said cantilevered support structure; and a wench, wherein said wench varies the length of said cable thereby rotating said parallel support members about the deck structure of said vessel.

4. An improved method for installing the superstructure of an offshore platform comprising the steps of:

providing a floating vessel having a deck structure and a cantilevered support structure with at least two principal support trusses, each truss having two substantially parallel support members;

supporting the superstructure on said cantilevered support structure;

aligning said cantilevered support structure and the superstructure over the offshore platform;

rotating the parallel support members about the deck structure of said vessel to modify the height of said cantilevered support structure yet maintaining the top of said cantilevered support structure substantially parallel with the top of said offshore platform permitting the synchronized engagement of said superstructure with the offshore platform; and removing said floating vessel and cantilevered support structure attached thereto.

5. An improved method for installing a superstructure of an offshore platform comprising the steps of:

providing a floating vessel having a deck structure, a cantilevered support structure attached at one end of the deck structure, and a drilling vessel having a cantilevered drilling rig;

supporting the superstructure on said cantilevered support structure;

aligning said cantilevered support structure and superstructure over said offshore platform;

aligning said cantilevered drilling rig of said drilling vessel over said cantilevered support structure and superstructure;

lifting said superstructure with said cantilevered drilling rig;

removing said floating vessel having said cantilevered support structure attached thereto; and lowering said superstructure onto said offshore platform by means of said cantilevered drilling rig to join the superstructure to the offshore platform.

* * * * *